US010589755B2

(12) United States Patent
Fong et al.

(10) Patent No.: US 10,589,755 B2
(45) Date of Patent: Mar. 17, 2020

(54) AERIAL ROPE HOIST SYSTEM SUITABLE FOR AN OPEN PIT MINE

(71) Applicant: TIMBERLAND EQUIPMENT LIMITED, Woodstock (CA)

(72) Inventors: Benjamin Matthew Fong, Woodstock (CA); Clifford Jordan Trachsel, Ingersoll (CA)

(73) Assignee: TIMBERLAND EQUIPMENT LIMITED, Woodstock (CA)

( * ) Notice: Subject to any disclaimer, the term of this patent is extended or adjusted under 35 U.S.C. 154(b) by 324 days.

(21) Appl. No.: 15/453,242

(22) Filed: Mar. 8, 2017

(65) Prior Publication Data

US 2018/0257671 A1 Sep. 13, 2018

(51) Int. Cl.
*B61B 7/02* (2006.01)
*E21C 47/00* (2006.01)

(52) U.S. Cl.
CPC ..... *B61B 7/02* (2013.01); *E21C 47/00* (2013.01)

(58) Field of Classification Search
CPC .... B61B 7/00; B61B 7/02; B61B 7/04; B61B 7/045; B61B 7/06; B61B 9/00
See application file for complete search history.

(56) References Cited

U.S. PATENT DOCUMENTS 5,224,426 A * 7/1993 Rodnunsky ..... B61B 7/00 104/112

* cited by examiner

*Primary Examiner* — Robert J McCarry, Jr.
(74) *Attorney, Agent, or Firm* — Woodling, Krost and Rust

(57) ABSTRACT

An aerial rope tramway or slope hoist system suitable for use in an open pit mine or similar application. According to an embodiment, the aerial slope hoist system comprises an upper station and a lower station. The upper station is configured in proximity to a surface section of the open pit and the lower station is configured at a lower section of the open pit mine. According to an embodiment, the upper station comprises first and second towers and the lower station comprises first and second towers. The towers are configured to support respective ends of first and second suspension cable assemblies. Each of the suspension cable assemblies is configured to support and carry a trolley or skip. The system comprises a hoist configured to move the respective trolleys in opposite directions. The towers for the lower station are configured to be moveable and provide the capability to break down the system and/or lengthen or reduce the span of the system.

14 Claims, 5 Drawing Sheets

AERIAL ROPE HOIST SYSTEM SUITABLE FOR AN OPEN PIT MINE

FIELD OF THE INVENTION

The present invention relates to a hoist system, and more particularly, to an aerial rope tramway or slope hoist system suitable for use in an open pit mine or similar application.

BACKGROUND OF THE INVENTION

Open pit mines traditionally utilize a fleet of large trucks to haul the ore, or coal, and overburden, from the pit bottom of the mine along unpaved and winding tracks or roads to dumping area(s) outside of the pit, or to a primary crusher station near the rim or surface of the pit mine. Due to the nature of the tracks or roads and the heavy loads, the trucks are forced to move slowly up and out of the pit. In addition, due to the constant and heavy truck traffic, considerable costs are incurred to maintain these road or pathways.

In addition, rising fuel prices and increasingly stringent environmental regulations serve to further constrain or limit such traditional open pit mining truck haulage operations.

In view of at least these drawbacks, there remains a need for improvements in the art.

BRIEF SUMMARY OF THE EMBODIMENTS

The present invention is directed to an aerial rope tramway or slope hoist system suitable for installation and/or use in an open pit mine operation.

According to one embodiment, the present invention comprises an aerial rope hoist system configured for hauling material from an open pit mine, the aerial rope hoist system comprises: an upper station configured in proximity to a surface section of the open pit mine; a lower station configured at a lower section of the open pit mine; the upper station comprising first and second towers, the first tower being configured for supporting one end of a first suspension cable assembly, and the second tower being configured to support one end of a second suspension cable assembly; the lower station comprising moveable first and second lower towers, the moveable first lower tower being configured to support the other end of the first suspension cable assembly, and the moveable second lower tower is configured to support the other end of the second suspension cable assembly; a first trolley operatively coupled to the first suspension cable assembly and configured to support a first container; a second trolley operatively coupled to the second suspension cable assembly and configured to support a second container; a first haul rope coupled to the first trolley at one end and operatively coupled to a hoist at another end; a second haul rope coupled to the second trolley at one end and operatively coupled to the hoist at another end; and the hoist is configured to move the first trolley and the second trolley in opposite directions on the respective first suspension cable assembly and second suspension cable assembly.

According to another embodiment, the present invention comprises an aerial rope hoist system configured for hauling material from an open pit mine, the aerial rope hoist system comprising: an upper station configured in proximity to a surface section of the open pit mine; a lower station configured at a lower section of the open pit mine; a first suspension cable assembly comprising first and second suspension cables, and a second suspension cable assembly comprising first and second suspension cables; the upper station comprising first and second towers, the first tower being configured for supporting one end of each of the first and second suspension cables in the first suspension cable assembly, and the second tower being configured for supporting one end of each of the first and second suspension cables in the second suspension cable assembly; the lower station comprising moveable first and second lower towers, the moveable first lower tower being configured to support the other ends of the first and second suspension cables in the first suspension cable assembly, and the moveable second lower tower being configured to support the other ends of the first and second suspension cables in the second suspension cable assembly; a first trolley operatively coupled to the first and second suspension cables and configured to support a first container; a second trolley operatively coupled to the first and second suspension cables in the second suspension cable assembly and configured to support a second container; a first haul rope coupled to the first trolley at one end and operatively coupled to a hoist at another end; a second haul rope coupled to the second trolley at one end and operatively coupled to the hoist at another end; and the hoist being configured to move the first trolley and said second trolley in opposite directions on the respective first and second suspension cables in the first suspension cable assembly and the respective first and second suspension cables in the second suspension cable assembly.

Other aspects and features of the present invention will become apparent to those ordinarily skilled in the art upon review of the following description of embodiments of the invention in conjunction with the accompanying figures.

BRIEF DESCRIPTION OF THE DRAWINGS

Reference will now be made to the accompanying drawings which show, by way of example, embodiments of the present invention, and in which.

Like reference numerals indicate like or corresponding elements or components in the drawings.

DETAILED DESCRIPTION OF THE EMBODIMENTS OF THE INVENTION

Figure 1:
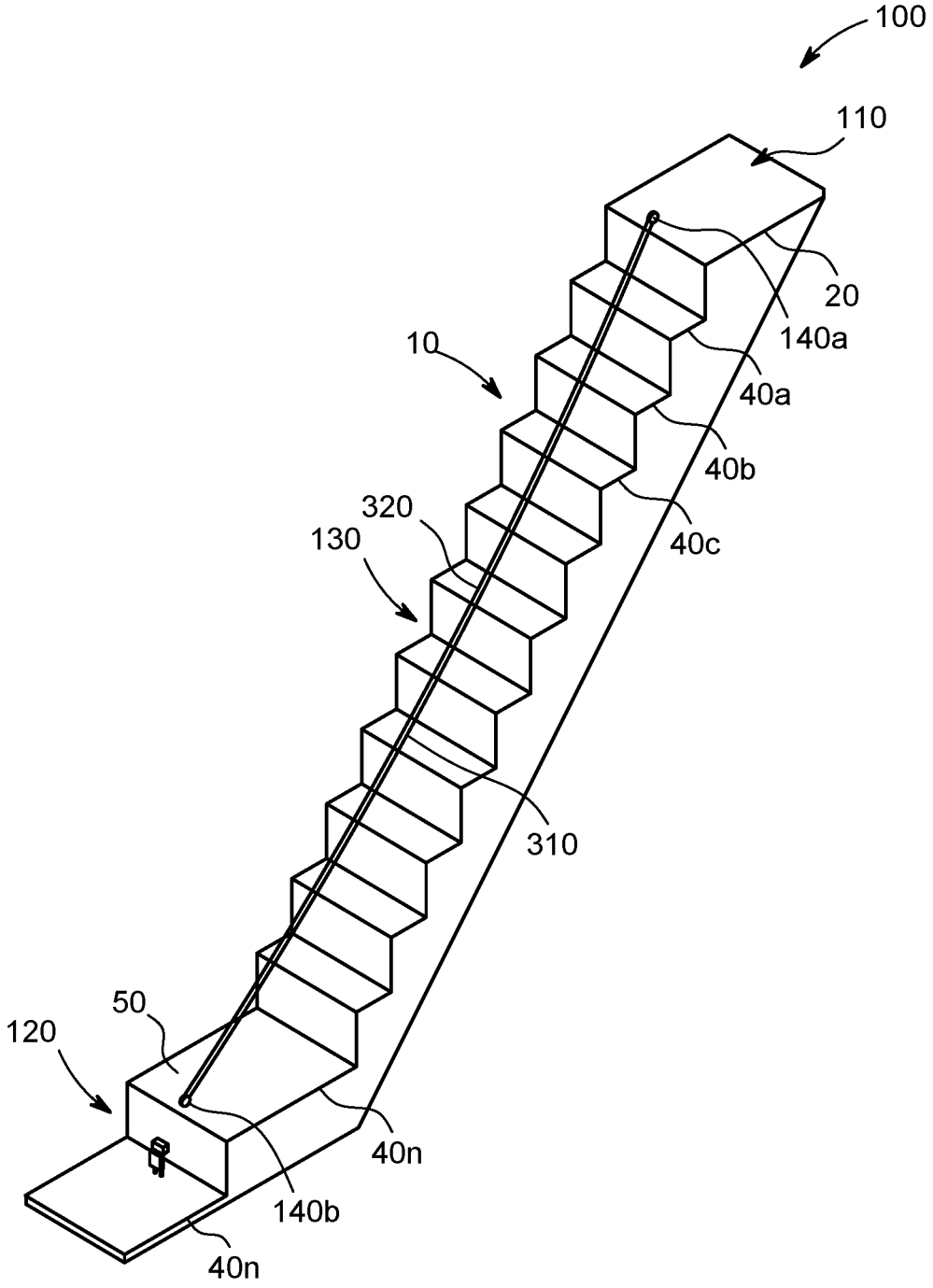
FIG. 1 is a perspective view of an aerial rope tramway or slope hoist system in an open pit mine operation according to an embodiment of the present invention.

Reference is first made to FIG. 1, which shows an aerial rope tramway or slope hoist system according to an embodiment of the present invention and indicated generally by reference 100. The aerial rope slope hoist system 100 is shown installed in an open pit mine, illustrated in a sectional view and indicated generally by reference 10. The open pit mine 10 comprises a top surface or upper section indicated by reference 20 and a bottom or lower surface indicated by reference 30. In known manner, the open pit mine 10 has a pit wall comprising a series of ledges or steps 40, indicated individually by references 40*a*, 40*b*, 40*c* . . . 40*n*, which are formed as the open pit mine is excavated deeper and the material removed. The ledges 40 also serve as roadways for trucks, for example, indicated by reference 50, to move ore, other material, or machinery or apparatus, in and out of the mine 10 during normal operation, as will be understood by those skilled in the art. As will be described in more detail below, the aerial rope tramway or slope hoist system 100 provides a mechanism for efficiently moving material from the mine 10 and often along the shortest route possible, e.g. straight up the pit wall, as depicted in FIG. 1. It is to be appreciated that while the aerial slope hoist system 100 is described in the context of an open pit mine and mining operation, the aerial slope hoist system 100 and mechanism have wider applicability.

Figure 2:
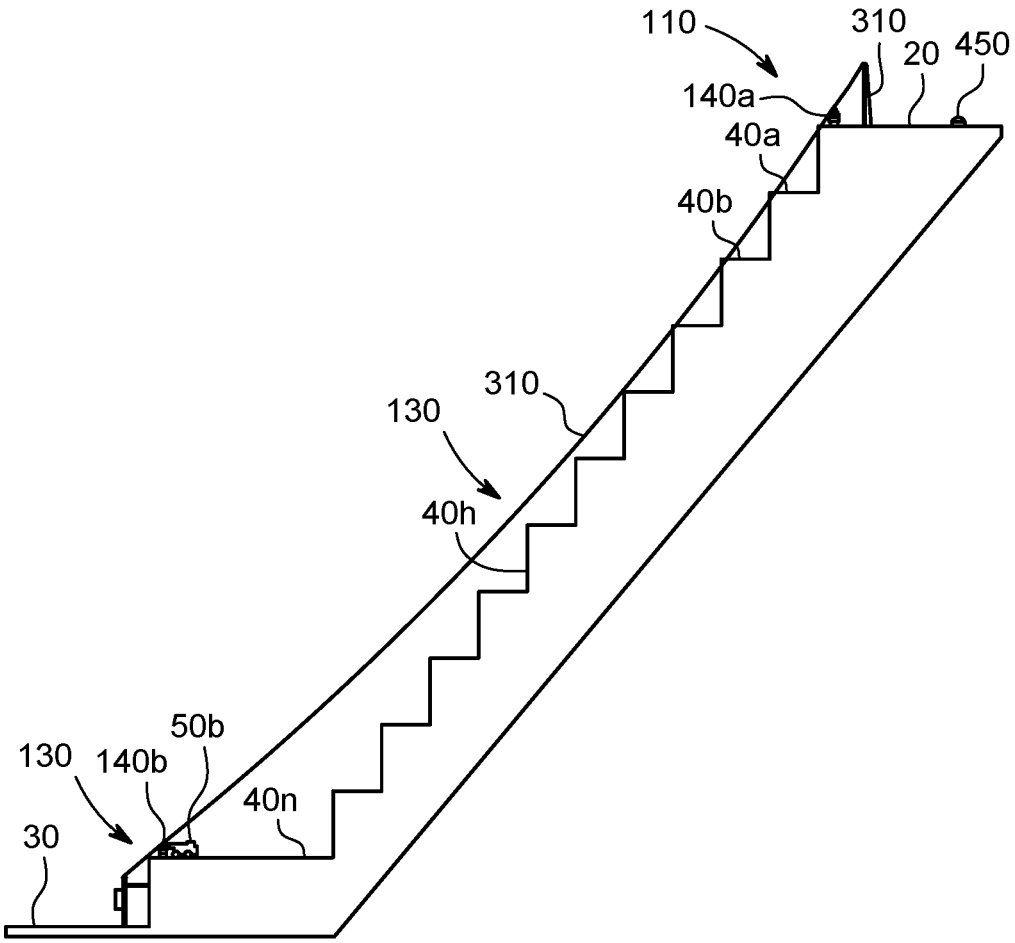
FIG. 2 is a side view of the aerial rope tramway or slope hoist system of FIG. 1.
Figure 3:
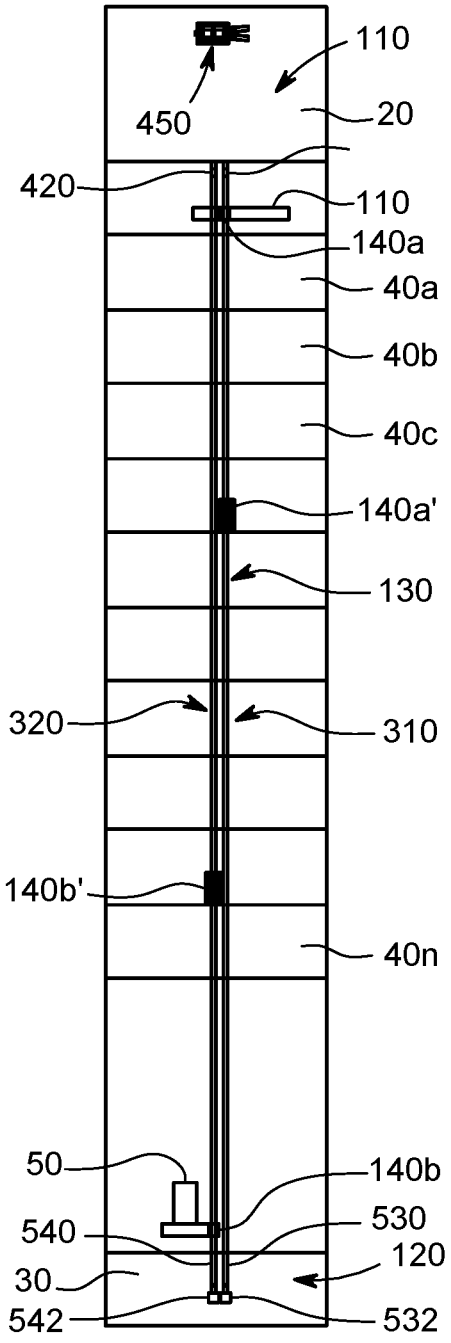
FIG. 3 is a top view of the aerial rope tramway or slope hoist system of FIG. 1.

As shown in FIG. 1, the aerial slope hoist system 100 comprises a top or upper station or installation indicated generally by reference 110, a lower or bottom station or installation indicated generally by reference 120 and a haul cable or ropeway span between the upper station 110 and the lower station 120, indicated generally by reference 130. The upper station 110 is configured or installed at the top surface 20 (or one of the upper ledges 40*a*) of the open pit mine 10, whereas, the lower station 120 is configured or installed at the bottom 30 of the mine 10 or one of the lower ledges 40*n*-1, 40*n* of the mine 10. The haul ropeway 130 is configured to span the ledges 40 between the upper 110 and lower 120 stations as shown in FIGS. 1, 2 and 3, and move containers, e.g. skips, indicated generally by reference 140 back and forth between the lower 120 and upper 110 stations. According to an exemplary implementation, the haul ropeway 130 is installed in a substantially perpendicular configuration in order to provide the shortest possible haulage route or path for removing material from the mine 10.

Figure 4:
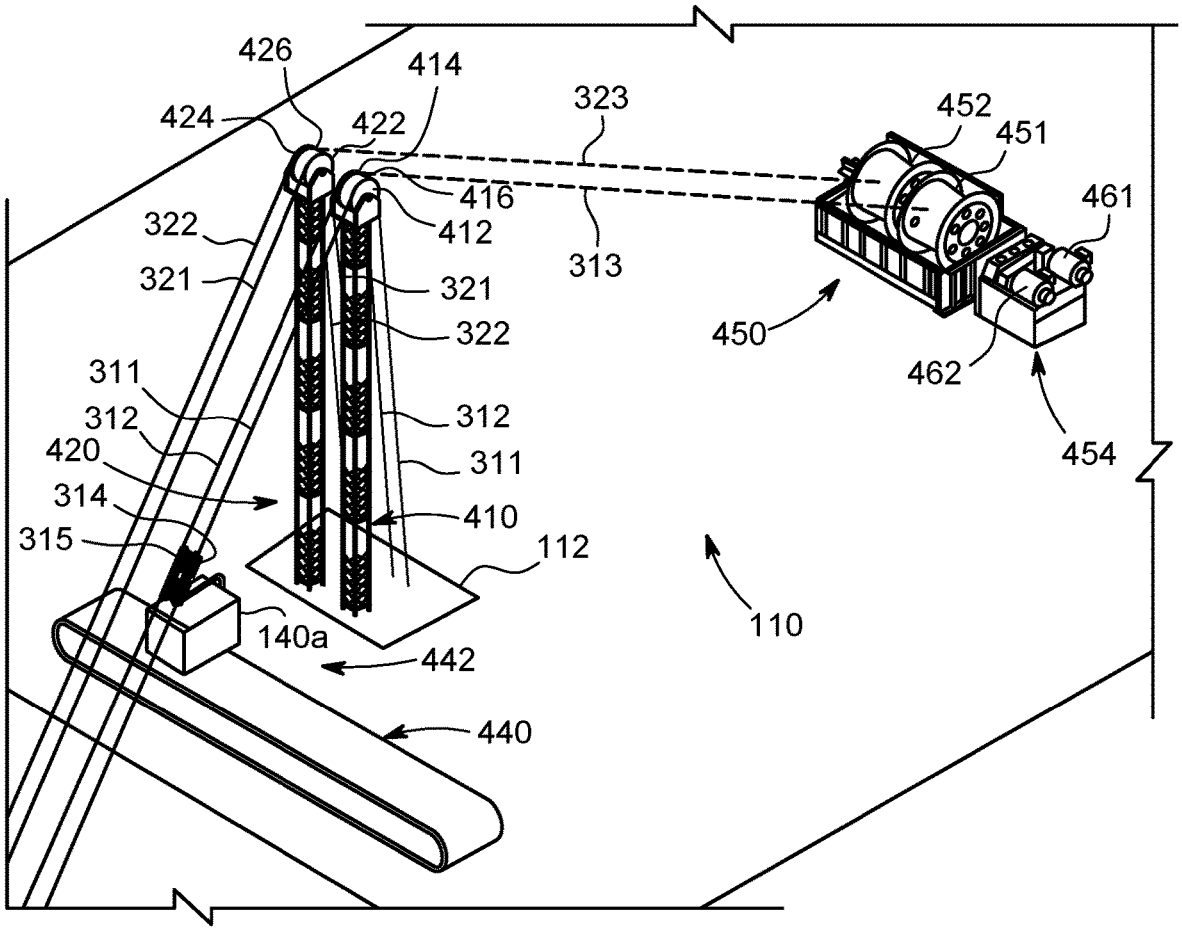
FIG. 4 shows a surface station or installation for the aerial rope tramway or slope hoist system according to an embodiment of the present invention.
Figure 5:
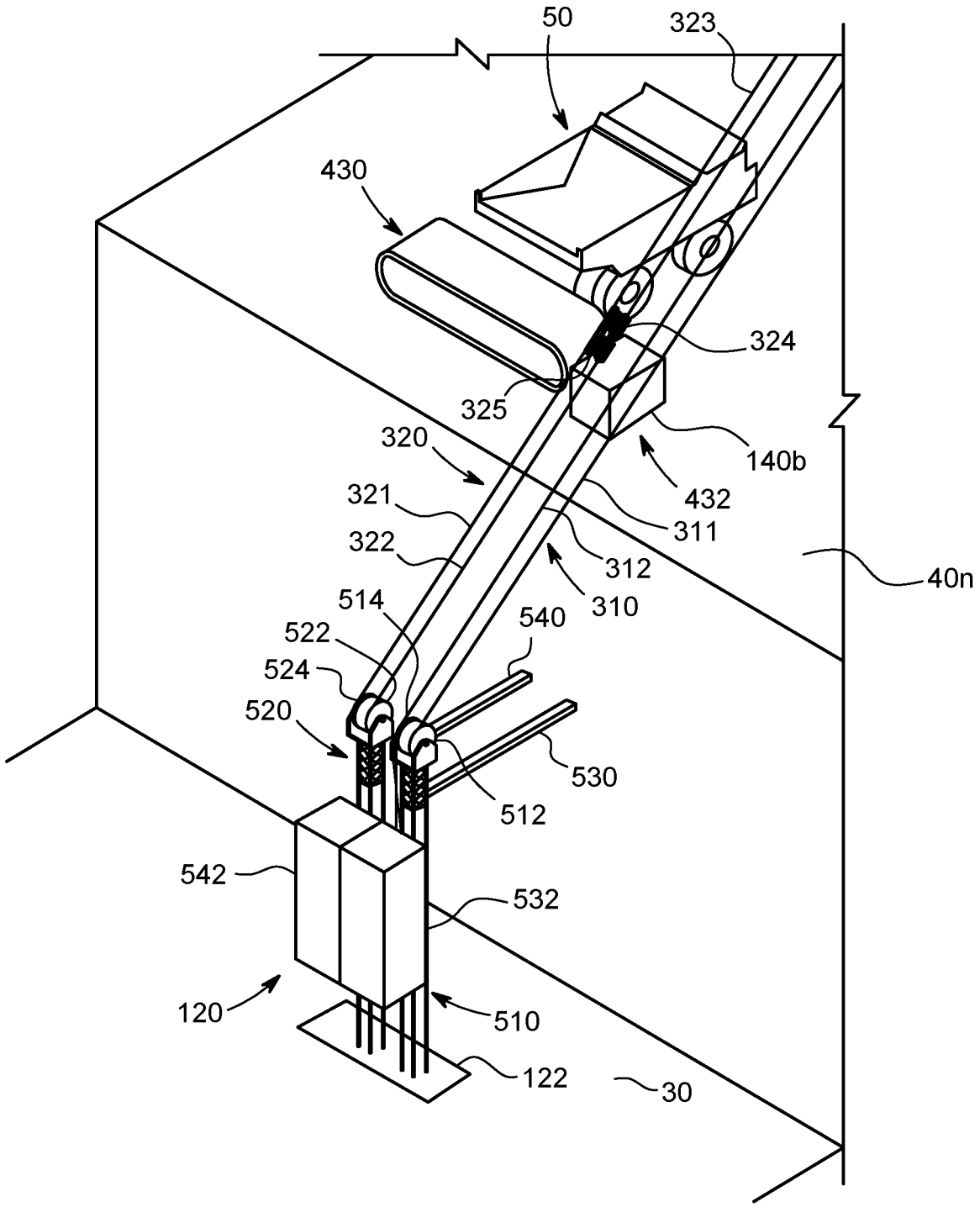
FIG. 5 shows a lower station for the aerial rope tramway or slope hoist system according to an embodiment of the present invention.

In operation, as shown in FIG. 5, a truck 50 unloads ore, or other excavated material from the mine, onto a loading platform 430, for example, a conveyor, which is located at a lower ledge or section 40*n* of the mine 10, for example, a loading socket or station indicated generally by reference 432. The loading socket 432 may be configured with one or more sensors and spring dampened stops and/or locks for sensing and controlling the stopping or motion of the skip 140*b*. The conveyor 430 loads the ore into the empty skip 140*b*. The loaded skip 140*b* is hauled to surface and the ore, i.e. payload, is unloaded onto another conveyor 440, or other type of loading platform or apparatus, located at an unloading socket 442, as shown in FIG. 4. The unloading socket 442 may be configured with one or more sensors for sensing motion of the skip 142, and/or spring dampened stops controlling the stopping and motion of the loaded skip 140*a*. The material from the skip 140*a* is loaded onto another truck, rail car or the like, for transport from the mine 10. It will be appreciated that the aerial hoist system 100 according to the present invention can effectively reduce the number of trucks, or other transport vehicles, used in a typical open pit mine operation, leading not only to a cost reduction for required number of trucks, but also lessening the environmental impact from a fleet of trucks. According to another aspect, the reduced footprint of the aerial hoist system 100 can open up other areas of an open pit for operation that would not be accessible by other access or haulage due to the large footprint.

According to an embodiment, the haul ropeway 130 is configured as a one-rope-on and a one-rope-off system, and comprises a first cable assembly 310 and a second cable assembly 320 as shown in FIG. 3. In an exemplary implementation, the first cable assembly 310 comprises first and second suspension cables, i.e. ropes, indicated by references 311 and 312, and a haul rope 313, as shown in FIGS. 4 and 5. A trolley or carriage 314 is mounted on and supported by the suspension cables 311, 312 as shown in FIG. 4. The trolley 314 is configured to support a mining skip or haul container 140*a*. The haul rope 313 is connected to the trolley 314 and operatively coupled to a hoist motor system as shown in FIG. 4, and indicated generally by reference 450. The trolley 314 also includes an emergency brake gripper system indicated generally by reference 315, which is configured with spring actuated mechanisms for gripping the suspension cables 311 and 312, when tension on the haul rope 313 is released. According to another aspect, a Festoon system is included and configured to be supported by the suspension cables to manage slack in the haul rope 313.

Similarly, the second cable assembly 320 comprises first and second suspension cables, indicated by references 321 and 322, and a haul rope 323, as shown in FIGS. 4 and 5. A second trolley or carriage 324 is mounted to the first and second suspension cables 321 and 322. The haul rope 323 is connected to the trolley 324 and operatively coupled to the hoist system 450 (FIG. 4). The trolley 324 also includes brake gripper system indicated generally by reference 325, which is configured with a spring actuated mechanism for gripping the suspension cables 321 and 322, when tension on the haul rope 323 is released. According to another aspect, a Festoon system is configured to be supported by the suspension cables to manage the slack haul rope 323, the particular implementation details which will be understood by one skilled in the art.

As shown in FIG. 4, the upper station 110 comprises first and second towers indicated generally by references 410 and 420. According to an exemplary implementation, the towers 410 and 420 are mounted and secured in a base structure 112, for example, a concrete pad. The first tower 410 is configured to support and secure one end of the suspension cables 311 and 312. The ends of the suspension cables 311 and 312 are further secured or anchored in the base structure 112 using known anchoring mechanisms. The anchoring mechanisms may be configured to be detachable to allow adjustability of the system, e.g. extension of the span, and/or breakdown of the system for relocation or shipping. Storage reel(s) may also be provided for storing unused extra length of the suspension cables 311 and 312. According to an embodiment, the tower 410 is configured with a pair of sheave pulleys, indicated by references 412 and 414, configured for supporting the suspension cables 311 and 312, and also for adjusting the suspension cables, for example, when the span of the system 100 is being increased to provide access to a lower level of the open pit mine 10. The tower 410 is also configured with a sheave 416 for guiding the haul rope 313 and which is configured to rotate bidirectionally. Similarly, the second tower 420 is configured to support and secure one end of the suspension cables 321 and 322 of the second cable assembly 320. The ends of the suspension cables 321 and 322 are secured in the base structure 112 using known and suitable anchoring mechanisms, as will be within the understanding of those skilled in the art. As described above, the anchoring mechanisms may be further configured to be detachable to allow adjustability of the system, e.g. extension of the span, or breakdown of the system. Storage reel(s) may also be provided for storing unused extra length of the suspension cables 321 and 322. As shown, the second tower 420 is also configured with a pair sheave pulleys, indicated by references 422 and 424, configured for supporting the suspension cables 321 and 322 and allowing the length of the suspension cables to be adjusted, e.g. lengthened to increase the span to a lower level in the pit 10. The second tower 420 is also configured with a sheave 426 for guiding the haul rope 323 and which is configured to rotate bi-directionally.

Referring to FIG. 5, the lower station or installation 120 is similarly configured with first and second towers indicated by references 510 and 520. The first and second towers 510 and 520 are mounted and secured in a corresponding base structure 122, for example, a concrete pad or base made from aggregate, and are configured to secure the lower ends of the first 310 and the second 320 suspension cable assemblies. According to another aspect, the towers 510 and 520 are configured to be removable to provide the capability to adjust the span of the system 100. According to another embodiment, the first and second towers 510 and 520 are configured to be mounted directly into the base of the open pit mine 10. The first and second towers 510 and 520 are further secured by respective braces or struts 530 and 540 which are adjustable/removable and connected at one end to the respective tower 510, 520. The other end of each the braces 530 and 540 is securely anchored the wall of the open pit mine 10 as shown in FIG. 5. The lower end of each of the suspension cables 311 and 312 is connected and secured to a counter weight indicated by reference 532. Similarly, the lower end of each of the suspension cables 321 and 322 is connected and secured to another counter weight indicated by reference 542. The counter weights 532 and 542 can comprise concrete blocks or heavy duty metal containers filled with ore or other heavy mine material. The counter weights 532, 542 are configured to tension the suspension cables 311, 312 and 321, 322, respectively, while at the same allowing play or controlled movement in the suspension cables. The counter weights 532, 542 can also serve to more securely anchor the first and second towers 510 and 520 by generating a downwardly acting force. According to another embodiment, the suspension cables 311, 312 and 321, 322 may be secured without the use of counter weights, for example, in a manner as described above. The arrangement of the counter weights 532, 542 (and the braces or struts 530 and 540) also facilitate the break down of the bottom installation 120 for movement and reinstallation of the lower towers 510 and 520. This provides the capability to extend or reduce the span or length of the slope hoist system 100. For example, as the open pit mine 10 is dug or excavated deeper, additional ledges 40 will be formed, and the slope hoist system 100 can be extended to these lower ledges by deploying additional length for the suspension cables 310, 320, and moving and reinstalling the lower towers 510, 520 and the braces 530, 540 (and the counterweights 532, 542) to one of the lower ledges 40 or the bottom of the pit mine 10. According to another aspect, the apparatus and components comprising the aerial slope hoist system 100 are easily disassembled, i.e. broken down, for transport or shipping, by truck or ship container, to a new mine location or continent.

According to an exemplary embodiment, the aerial slope hoist system 100 is configured with support towers at the top or upper installation 110 and with support towers at the lower or bottom installation 120, with no intermediate support towers, for example, on the ledge 40*h* (FIG. 2). One of the advantages of the embodiment described herein is that the configuration of the first suspension cable assembly 310, the second suspension cable assembly 320, and the towers 410, 420 and 510, 520, provides a suspension structure that does not necessarily require intermediate supports. It will, however, be appreciated that in some applications or installations, the inclusion of one or more intermediate towers may be desirable to provide additional support and/or reduce sag along a particularly lengthy span of the suspension cable assemblies 310 and 320. According to an exemplary implementation, the base towers 510 and 520 would remain in place, thereby becoming the intermediate towers, and new base towers (not shown) would be installed and the suspension cable assemblies 310 and 320 lengthened to extend the span of the system 100.

Reference is made back to FIG. 4, which shows the hoist motor system 450 according to an embodiment of the present invention in more detail. According to an exemplary implementation, the hoist system 450 comprises an electric or an electro-hydraulic hoist having a dual drum configuration comprising first and second drums 451 and 452, and a drive motor 454. According to an exemplary implementation, the drums 451, 452 are configured with Lebus grooving and mounted on a common shaft. The two drums 451, 452 comprise a one-rope-on and one-rope-off configuration, implemented for example, by configuring one of the drums to wind the haul rope and the other drum to unwind the haul rope, and vice versa. One of the drums may be configured with a clutch to engage or lock the respective haul rope and allow adjustment of the upper 410, 420 or the lower 510, 520 towers. For instance, when the drum is "de-clutched" additional length for the haul ropes are unwound from the drums 451, 452 thereby allowing the span of the system to be increased. According to another aspect, the drive motor 454 comprises two drive motors 461 and 462 to provide redundancy. According to a further aspect, the hoist system 450 includes braking and other safety systems for typical mining applications.

As described above and shown in FIG. 3, for example, the aerial slope system 100 is configured to operate as a bi-directional one-rope-on and one-rope-off system where one loaded skip moves upwards, for example, indicated by reference 140*a*', and the other empty skip, for example, indicated by reference 140*b*', moves in parallel downward to the bottom of the pit mine 10, as shown in FIG. 3. This configuration effectively counterbalances the dead weight, i.e. the weight of empty skips 140, so that power is consumed primarily to haul the load, i.e. the ore loaded in the skip 140*a* being raised to the surface of the mine 10.

According to an exemplary implementation, the hoist motor system 450 is implemented, i.e. "spec'd", for example, as follows:

- the hoist has 2 drums with Lebus grooving on a common shaft, configured for one-rope-on and one-rope-off operation;
- one of the drums is clutched to allow adjustment of the upper installation and/or the lower installation;
- each of the drums is configured for 4 rope layers and with a rope capacity for maximum pit depth travel or span; the "dead storage" wraps of the ropes are left on drums in early stages of mine depth;
- the hoist drums have a D:d ratio of 80:1;
- the deflector sheaves (or quad blocks) have a D:d ratio of 40:1;
- a single haul rope is provided for each trolley, with at least a diameter of ø1¾" (ø44 mm) to provide a safety factor of 4.0;
- a brake gripper system is provided for each trolley to grip or engage the suspension ropes when tension in the haul rope is released;
- two hoist drive motors to provide redundancy;
- the hoist motor system is configured/spec'd to provide a hoist speed up to 1000 ft/minute (305 m/min); and a slightly faster hoist speed at steady state taking into acceleration and deceleration zones.

It will be appreciated that the components and exemplary specifications will vary and be adjusted according to the particular application and/or installation in accordance with the embodiments as disclosed herein, as will be within the understanding of those skilled in the art.

According to an exemplary implementation, the following performance and operational features may be achieved:

- a maximum vertical depth of approximately 1,119 ft (341 m); and a maximum horizontal distance of approximately 942 ft (287 m);
- installation an open pit mine having a slope of 50 degrees;
- support towers at top and bottom; intermediate towers optional and not necessary for all installations;
- additional towers may be added for additional support, for example, if required according to terrain or a long haul;
- a maximum system load of approximately 24 tons (48,000 lbs.) per skip plus dead weight of approximately 10 tons (20,000 lbs.)
- suspension ropes having a diameter of approximately 2¼" (ø57 mm) per skip and configured to provide a safety factor of 3.0;
- a Festoon system supported by suspension ropes for managing slack in the haul rope;
- a counter-weighted support rope tension system, for example, implemented with concrete weights at the bottom installation; facilitates break down and reinstallation or movability of the lower support towers for extending (or reducing) the span of the system or to break down the system for shipping;
- two skips or containers, with one skip hauling material to the surface, and the other skip returning to the bottom in parallel for refilling;
- it has been found that the aerial slope hoist system can provide the production of approximately 10 conventional mine trucks.

It will be appreciated that these features or operational/implementation characteristics are exemplary and will vary according to the application and/or installation in accordance with the embodiments as disclosed herein, as will be within the understanding of those skilled in the art.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. An aerial rope hoist system configured for hauling material from an open pit mine, said aerial rope hoist system comprising:

- an upper station configured in proximity to a surface section of the open pit mine;
- a lower station configured at a lower section of the open pit mine;
- said upper station comprising first and second towers, said first tower being configured for supporting one end of a first suspension cable assembly, and said second tower being configured to support one end of a second suspension cable assembly;
- said lower station comprising moveable first and second lower towers, said moveable first lower tower being configured to support the other end of said first suspension cable assembly, and said moveable second lower tower being configured to support the other end of said second suspension cable assembly;
- a first trolley operatively coupled to said first suspension cable assembly and configured to support a first container;
- a second trolley operatively coupled to said second suspension cable assembly and configured to support a second container;
- a first haul rope coupled to said first trolley at one end and operatively coupled to a hoist at another end;
- a second haul rope coupled to said second trolley at one end and operatively coupled to said hoist at another end; and
- said hoist being configured to move said first trolley and said second trolley in parallel and in opposite directions on said respective first suspension cable assembly and second suspension cable assembly, wherein said first trolley and said first container and said second trolley and said second container provide a counterbalance for each other.

2. The aerial rope hoist system as claimed in claim 1, wherein said lower station further includes first and second counterweights, said first counterweight being configured to attach the other end of said first suspension cable assembly and tension said first suspension cable assembly, and said second counterweight being configured to attach the other end of said second suspension cable assembly and tension said second suspension cable assembly.

3. The aerial rope hoist system as claimed in claim 2, wherein said lower station further includes first and second braces for further securing said first and second lower towers, said first brace having one end coupled to said first lower tower and another end anchored to a surface of the open pit mine, and said second brace having one end coupled to said second lower tower and another end anchored to a surface of the open pit mine.

4. The aerial rope hoist system as claimed in claim 3, wherein said hoist comprises a first drum and a second drum, said first drum and said second drum being mounted on a common drive shaft, and said hoist including a drive motor operatively coupled to said common drive shaft, and said hoist including a controller for rotating said first drum and said second drum in a forward direction and in a reverse direction for spooling and for unwinding said haul rope coupled to said respective first and second drums.

5. The aerial rope hoist system as claimed in claim 4, wherein said first trolley includes a brake system operatively coupled to said first suspension cable assembly for securing said first trolley when said first haul rope loses tension, and wherein said second trolley includes a brake system operatively coupled to said second suspension cable assembly for securing said second trolley when said second haul rope loses tension.

6. The aerial rope hoist system as claimed in claim 1, wherein said first suspension cable assembly comprises first and second cables, and said first trolley is configured to be supported by each of said first and second cables.

7. The aerial rope hoist system as claimed in claim 6, wherein said second suspension cable assembly comprises first and second cables, and said second trolley is configured to be supported by each of said first and second cables.

8. The aerial rope hoist system as claimed in claim 7, wherein said lower station further includes first and second counterweights, said first counterweight being configured to secure one end of each of said first and second cables in said first suspension cable assembly and tension said first and second cables, and said second counterweight being configured to secure one end of each of said first and second cables in said second suspension cable assembly and tension said first and second cables.

9. The aerial rope hoist system as claimed in claim 8, wherein said first suspension cable assembly includes a Festoon mechanism supported by said first and second cables and configured to control any slack arising in said first haul rope, and wherein said second suspension cable assembly includes a Festoon mechanism supported by said first and second cables and configured to control any slack arising in said second haul rope.

10. An aerial rope hoist system configured for hauling material from an open pit mine, said aerial rope hoist system comprising:

an upper station configured in proximity to a surface section of the open pit mine;

a lower station configured at a lower section of the open pit mine;

a first suspension cable assembly comprising first and second suspension cables, and a second suspension cable assembly comprising first and second suspension cables;

said upper station comprising first and second towers, said first tower being configured for supporting one end of each of said first and second suspension cables in said first suspension cable assembly, and said second tower being configured for supporting one end of each of said first and second suspension cables in said second suspension cable assembly;

said lower station comprising moveable first and second lower towers, said moveable first lower tower being configured to support the other ends of said first and second suspension cables in said first suspension cable assembly, and said moveable second lower tower being configured to support the other ends of said first and second suspension cables in said second suspension cable assembly;

a first trolley operatively coupled to said first and second suspension cables and configured to support a first container;

a second trolley operatively coupled to said first and second suspension cables in said second suspension cable assembly and configured to support a second container;

a first haul rope coupled to said first trolley at one end and operatively coupled to a hoist at another end;

a second haul rope coupled to said second trolley at one end and operatively coupled to said hoist at another end; and said hoist being configured to move said first trolley and said second trolley in parallel and in opposite directions on said respective first and second suspension cables in said first suspension cable assembly and said respective first and second suspension cables in said second suspension cable assembly, wherein said first trolley and said first container and said second trolley and said second container provide a counterbalance for each other, so that power from said hoist is primarily utilized for load hauling.

11. The aerial rope hoist system as claimed in claim 10, wherein said lower station further includes first and second counterweights, said first counterweight being configured to secure one end of each of said first and second cables in said first suspension cable assembly and tension said first and second cables, and said second counterweight being configured to secure one end of each of said first and second cables in said second suspension cable assembly and tension said first and second cables.

12. The aerial rope hoist system as claimed in claim 10, wherein said lower station further includes first and second braces for further securing said first and second lower towers, said first brace having one end coupled to said first lower tower and another end anchored to a surface of the open pit mine, and said second brace having one end coupled to said second lower tower and another end anchored to a surface of the open pit mine.

13. The aerial rope hoist system as claimed in claim 11, wherein said hoist comprises a first drum and a second drum, said first drum and said second drum being mounted on a common drive shaft, and said hoist including a drive motor operatively coupled to said common drive shaft, and said hoist including a controller for rotating said first drum and said second drum in a forward direction and in a reverse direction for spooling and for unwinding said haul rope coupled to said respective first and second drums.

14. The aerial rope hoist system as claimed in claim 13, wherein said first trolley includes a brake system operatively coupled to said first and second suspension cables in first suspension cable assembly for securing said first trolley when said first haul rope loses tension, and wherein said second trolley includes a brake system operatively coupled to said first and second suspension cables in said second suspension cable assembly for securing said second trolley when said second haul rope loses tension.

* * * * *